US008397831B2

(12) United States Patent
Wan et al.

(10) Patent No.: US 8,397,831 B2
(45) Date of Patent: Mar. 19, 2013

(54) ROTARY TOOL HAVING A MANUAL RATCHET MECHANISM

(75) Inventors: Mohsein Wan, Bukit Mertajam Penang (MY); Manfred Lutz, Filderstadt (DE); Romli Norrofaizi, Ampat Penang (MY)

(73) Assignee: Robert Bosch GmbH, Stuttgart (DE)

( * ) Notice: Subject to any disclaimer, the term of this patent is extended or adjusted under 35 U.S.C. 154(b) by 10 days.

(21) Appl. No.: 12/488,663

(22) Filed: Jun. 22, 2009

(65) Prior Publication Data

US 2010/0071922 A1 Mar. 25, 2010

(30) Foreign Application Priority Data

Jun. 25, 2008 (EP) ..... 08104538

(51) Int. Cl.
*B25B 27/00* (2006.01)
*B25B 15/04* (2006.01)

(52) U.S. Cl. ..... 173/29; 173/47; 81/57.11; 81/58.1; 81/57.22

(58) Field of Classification Search ..... 173/29, 173/47, 216, 217; 81/57.22, 57.23, 58.1, 81/57.11, 61
See application file for complete search history.

(56) References Cited

U.S. PATENT DOCUMENTS

| | | | | |
|---|---|---|---|---|
| 3,120,845 | A * | 2/1964 | Horner | 606/180 |
| 3,802,518 | A * | 4/1974 | Albert | 173/29 |
| 4,448,098 | A * | 5/1984 | Totsu | 81/467 |
| 6,666,284 | B2 * | 12/2003 | Stirm | 173/97 |
| 7,108,077 | B2 * | 9/2006 | Zaiser | 173/48 |
| 7,798,245 | B2 * | 9/2010 | Trautner | 173/48 |
| 2006/0243470 | A1 * | 11/2006 | Puzio | 173/217 |
| 2007/0201748 | A1 * | 8/2007 | Bixler et al. | 382/225 |
| 2007/0289759 | A1 * | 12/2007 | Hartmann et al. | 173/48 |
| 2008/0115632 | A1 * | 5/2008 | Hecht et al. | 81/177.1 |

FOREIGN PATENT DOCUMENTS

| | | | |
|---|---|---|---|
| DE | 4128651 | A1 | 3/1993 |
| DE | 102006054190 | A1 | 5/2008 |

* cited by examiner

*Primary Examiner* — M. Alexandra Elve
*Assistant Examiner* — Andrew M Tecco
(74) *Attorney, Agent, or Firm* — Kenyon & Kenyon LLP

(57) ABSTRACT

A rotary power tool according to the invention includes a manual ratchet mechanism having a driveshaft driven by a motor, an output shaft, a disengageable shaft coupling element for mechanically coupling the driveshaft to the output shaft, and a disengageable ratchet element for blocking rotation of the output shaft unidirectionally. The invention provides that one of the coupling element and the ratchet element is engaged, the other one is disengaged.

20 Claims, 5 Drawing Sheets

ROTARY TOOL HAVING A MANUAL RATCHET MECHANISM

CROSS-REFERENCE TO RELATED APPLICATION

This application is based on EP Application No. 08104538.7 filed Jun. 25, 2008.

BACKGROUND OF THE INVENTION

1. Field of the Invention

The present invention relates to a ratchet mechanism that permits a rotary power tool to be used in a manual ratchet mode for alternatively tightening or loosening a screw.

2. Description of the Prior Art

DE 4128651 A1 describes an electric screwdriver with a ratchet and pawl arrangement to permit manual screwdriving when the motor is inoperative. The tool operates in four distinct modes: forward and reverse power drill/driving modes plus forward and reverse manual ratchet modes. One of the four modes is conveniently selected via a rotating switch. In both of the manual ratchet modes, the motor is electrically decoupled via movement of electrical contacts that are mechanically coupled to the rotating switch. A problem with this design is that if the motor is inadvertently activated while the tool is in a ratchet mode, the motor could jam and possibly be damaged. It would be useful to have a rotary power tool with the manual ratchet functionality but without the associated risks to the motor.

ADVANTAGES OF THE INVENTION

A rotary power tool having a manual ratchet mechanism includes a driveshaft driven by a motor, an output shaft, a disengageable shaft coupling element for mechanically coupling the driveshaft to the output shaft, and a disengageable ratchet element for blocking rotation of the output shaft unidirectionally. When one of the coupling element and the ratchet element is engaged, the other one is disengaged. This design has the advantage that the motor is mechanically uncoupled from the output shaft when the ratchet element is operational, so that there is no possibility of damage to the motor should it be inadvertently activated.

The shaft coupling element can be conveniently engaged or disengaged by movement axially along a rotary axis of the tool. A preferred or default position can be established by providing a biasing member such as a coil spring to urge the shaft coupling element to move into either the engaged or the disengaged position.

The shaft coupling element is advantageously positioned between a transmission that modulates the output of the motor and the ratchet element. This allows an adjustment device in the form of a compact adjustment collar to access both the ratchet element and the shaft coupling element.

If the shaft coupling element is generally ring-shaped and at least partially surrounds the driveshaft and/or output shaft, then it can be conveniently positioned without a separate element for positioning it within the tool. Such an arrangement also facilitates implementation of the invention into existing power tool designs without requiring extensive redesign of the internal components.

By providing the shaft coupling element with splines for coupling with the driveshaft and/or the output shaft, rotational coupling is conveniently achieved while preserving freedom of movement in the axial direction.

Since the motor is provided with a motor housing which is mechanically coupled with the ratchet element and also unitary with the tool handle, the ratchet element is conveniently utilized to provide a screwdriving function to the tool by the user.

In its simplest form, ratchet action can be achieved by providing a ratchet element that includes a ratchet shaft interacting with at least one locking plate.

A mechanism for adjusting the operational mode of the rotary tool is mechanically coupled to the shaft coupling element and the ratchet element for adjusting each into either an engaged or a disengaged position. The adjustment mechanism therefore provide the basis for linking selection of the operational mode (drill/driving mode or ratchet mode) with the power state of the tool (powered or unpowered/manual).

Less parts are necessary and the design is more compact if the same adjustment mechanism that determine whether the tool operates in powered drill/driving mode or manual ratchet mode can also be used to determine the direction of unidirectional blocking by the ratchet element in manual ratchet mode.

A device for interfacing with the ratchet element and the shaft coupling element are conveniently adapted to the adjustment collar in the form of inner protrusions that contact the ratchet element and an inner cam surface for adjusting the shaft coupling element.

BRIEF DESCRIPTION OF THE DRAWINGS

The invention will be described in further detail below in conjunction with the drawings, in which.

DESCRIPTION OF THE PREFERRED EMBODIMENTS

Figure 1:
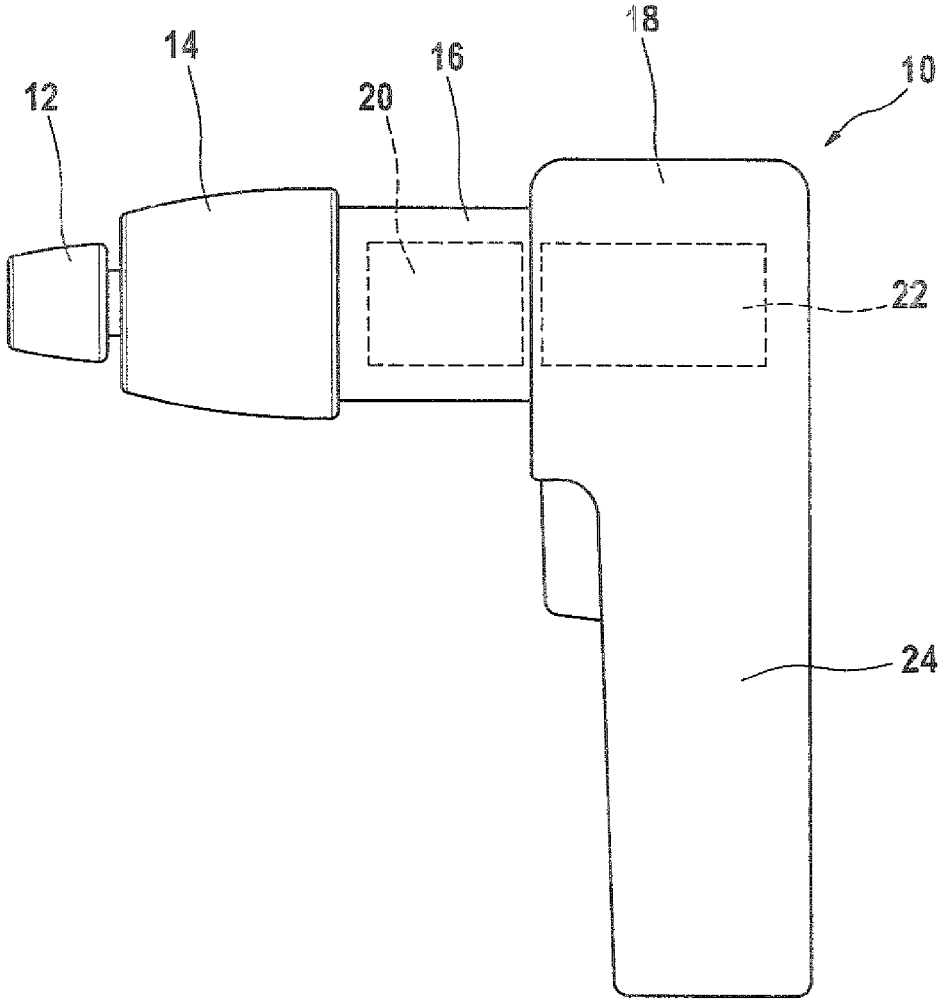
FIG. 1 is a schematic view of a power tool according to a first embodiment of the invention. Internal components are illustrated with dashed lines.

A rotary power tool 10 of the type used for power drilling or driving is shown in FIG. 1. The working end of the tool is configured with a tool holder 12 for securing drill or driver bits or the like. A rotatable adjustment collar 14 permits the user to select from a variety of operating modes. A gearbox housing 16 and a motor housing 18 secure a planetary gear transmission 20 and a motor 22, respectively. Alternatively the gearbox housing 16 and the motor housing 18 can be of unitary construction. The motor housing forms a portion of a larger tool shell that also includes a handle 24 for gripping the tool 10.

Figure 2:
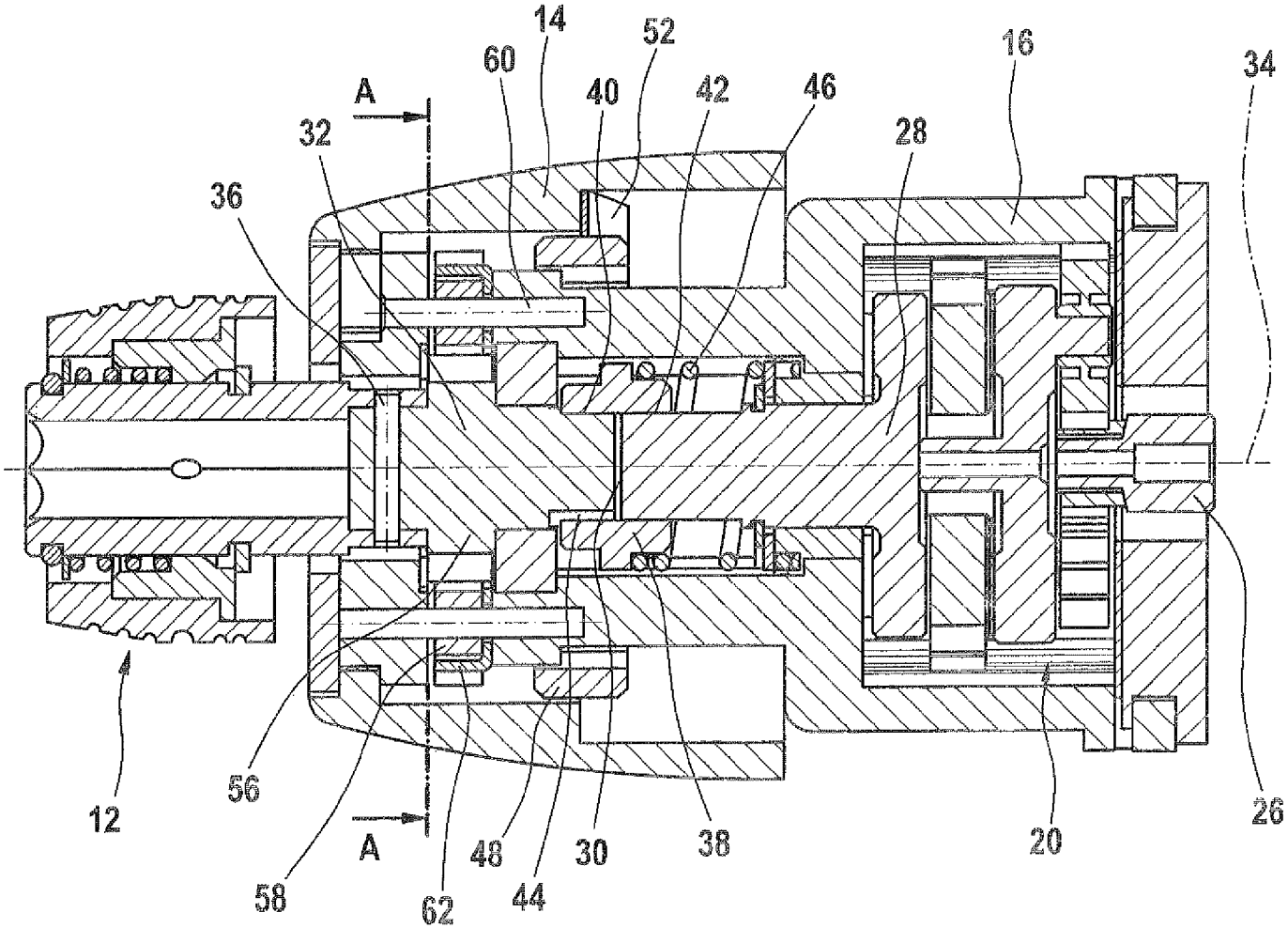
FIG. 2 is a partial section view of a power tool in powered drill/driving mode.

The working end of the tool 10 is illustrated in more detail in FIG. 2. A motor pinion 26 which is the output shaft of the tool motor 22 (FIG. 1) engages the planetary gear transmission 20 to drive a spindle 28. An air gap 30 separates the spindle 28 from a ratchet shaft 32, but they are both symmetrical about the same tool axis of rotation 34. The ratchet shaft 32 is mechanically coupled with a tool bit holder 12 via a pin 36 which can be omitted if the ratchet shaft 32 and tool bit holder 12 are instead constructed of unitary design.

For the purpose of the description that follows, rotating parts that are always rotationally coupled with the motor 22 will be considered to be a "driveshaft." Rotating parts that are always rotationally coupled with a tool (not shown) secured by the tool holder 12 are considered an "output shaft." In the preferred embodiment illustrated in the figures, the motor pinion 26 and the spindle 28 are always driveshafts, and the ratchet shaft 32 and tool bit holder 12 are each always output shafts.

A mechanical coupling between a driveshaft and output shaft can be established in certain circumstances so that rotation of a driveshaft will drive an output shaft. In the illustrated embodiment, a bushing 38 serves as shaft coupling means for this purpose. It is configured with internal splines 40 which are capable of cooperating with corresponding recesses 42 on the spindle 28 and/or recesses 44 on the ratchet shaft 32. Other manners of complementary part profiles are also possible so long as when the parts overlap axially, rotation of the bushing 38 is sufficient to drive the spindle 28 or the ratchet shaft 32 and vice versa.

Figure 3:
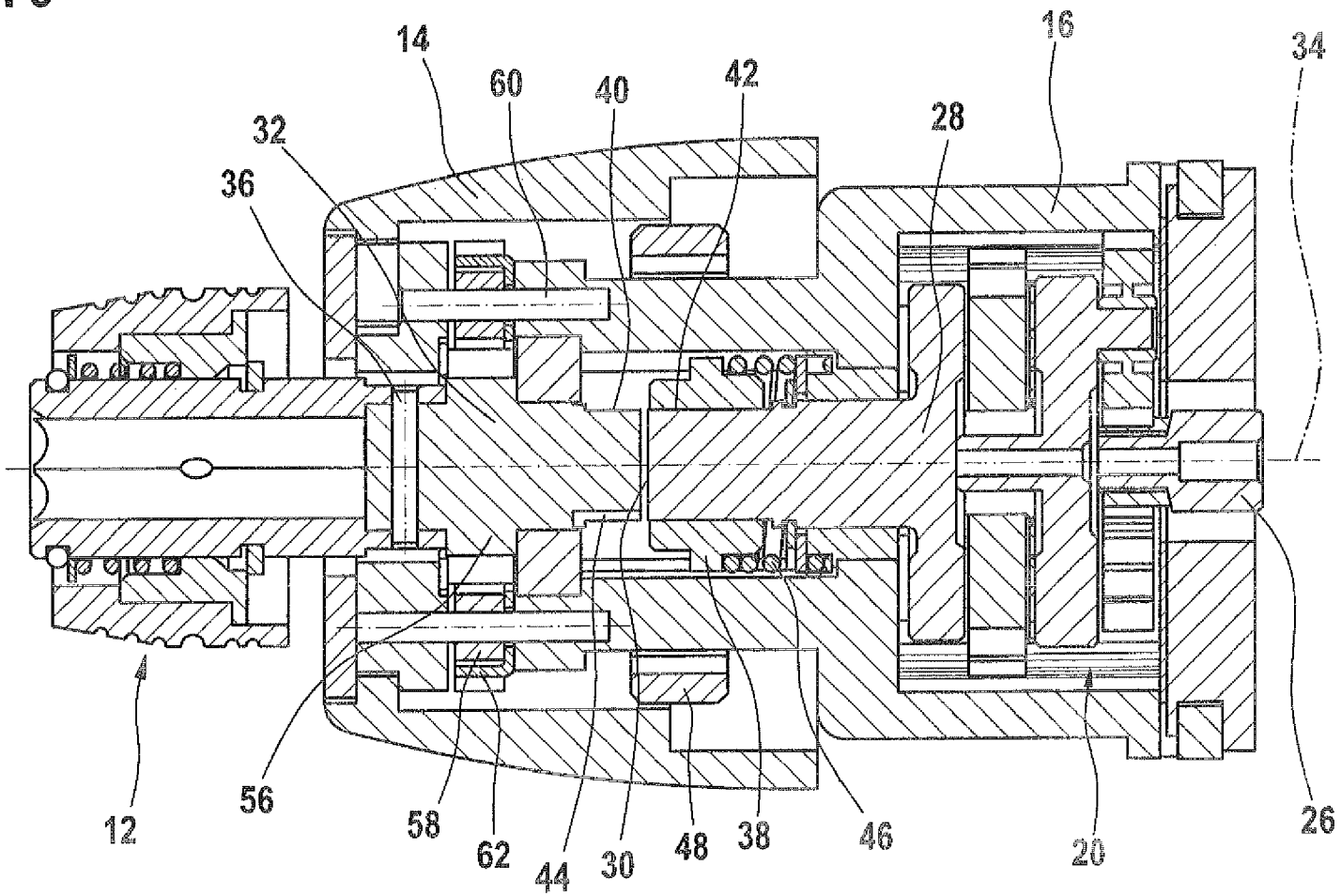
FIG. 3 is a partial section view of a power tool in manual ratchet mode.

In the power drill/driving mode illustrated in FIG. 2, the bushing 38 is mechanically coupled with both the spindle 28 and ratchet shaft 32. In other words, in this mode, rotation of a driveshaft will through this coupling rotate an output shaft. However, in the ratcheting mode of FIG. 3, the bushing 38 is in a different axial position, so that it is not in contact with the ratchet shaft 32. Rotation of a driveshaft in this mode will not rotate an output shaft.

The bushing 38 is normally biased into the position illustrated in FIG. 2 by a coil spring 46. However, rotation of the adjustment collar 14 can urge the bushing 38 to move into the position illustrated in FIG. 3. The coupling between the adjustment collar 14 and the bushing 38 is mediated by an adjustment ring 48 which contacts both parts.

Figure 4A:
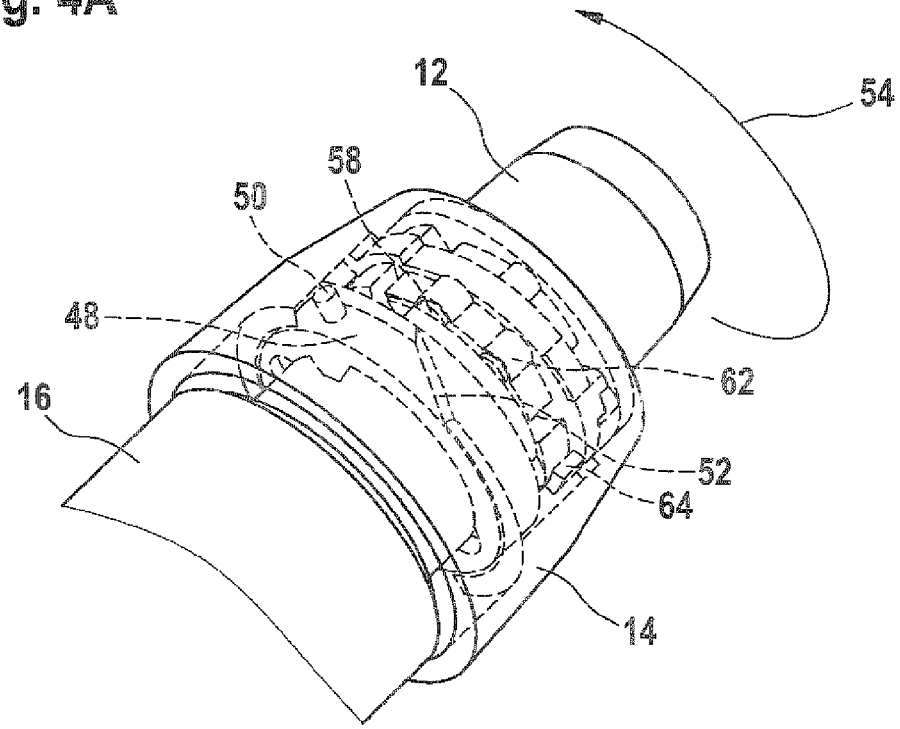
FIG. 4A is a partial perspective view of a power tool in powered drill/driving mode wherein the adjustment collar is shown in dashed lines.
Figure 4B:
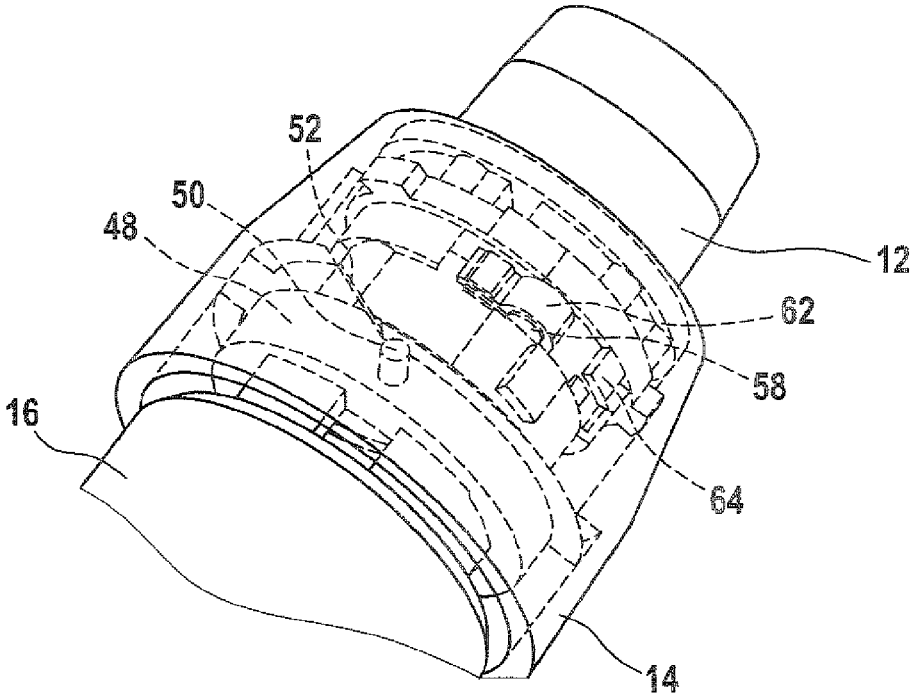
FIG. 4B is a partial perspective view of a power tool in manual ratchet mode wherein the adjustment collar is shown in dashed lines.

The adjustment ring 48 is provided with two projections 50 that cooperate with cam surfaces 52 on the inner portion of the adjustment collar 14 (see FIGS. 4A and 4B). Since the adjustment ring 48 is mechanically coupled with the bushing 38, the projections 50 are urged by the force of spring 46 into contact with the cam surfaces 52. The drill/driving mode illustrated in FIG. 4A. If the adjustment collar 14 is rotated in the direction of arrow 54, the cam surfaces 52 urge the adjustment ring 48 to move against the force of the spring 46, resulting in the position illustrated in FIG. 4B. Here the adjustment ring 48 has moved axially and the mechanically coupled bushing 38 has also moved axially so that it is in the position illustrated in FIG. 2.

Figure 5A:
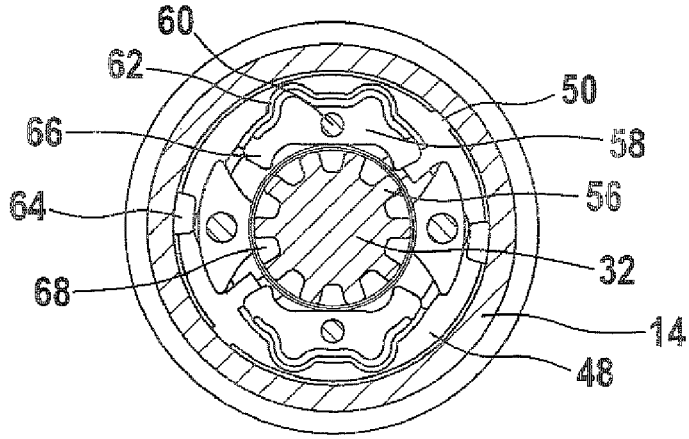
FIG. 5A is a section view taken along line A-A in FIG. 2 when the power tool is in powered drill/driving mode.
Figure 5B:
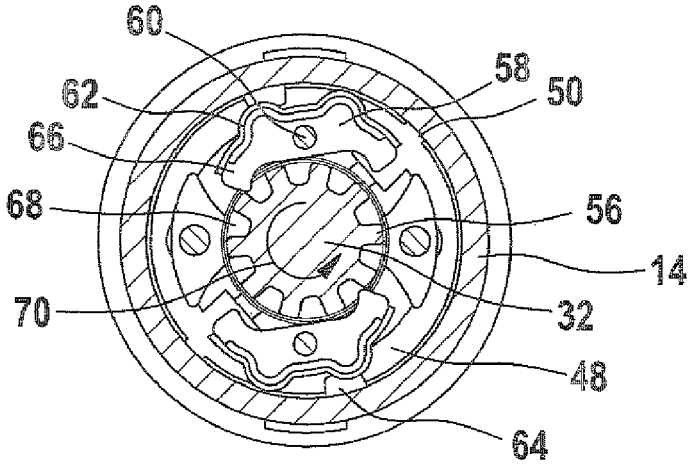
FIG. 5B is a section view taken along line B-B in FIG. 2 when the power tool is in reverse manual ratchet mode.
Figure 5C:
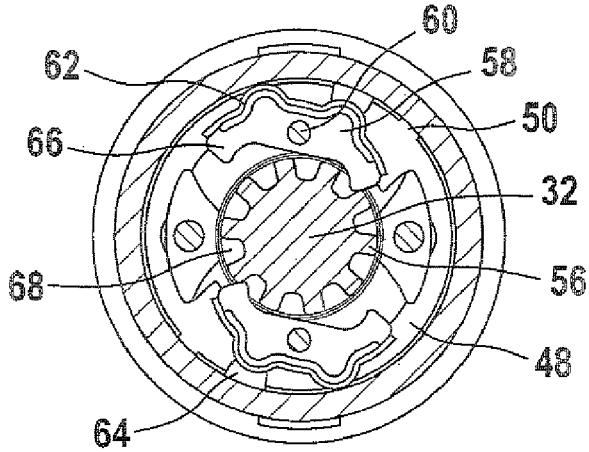
FIG. 5C is a section view taken along line B-B in FIG. 2 when the power tool is in forward manual ratchet mode.

FIGS. 5A, 5B and 5C are cross sectional views taken from the perspective of the working end of the tool and illustrate components of a ratchet means along with means for engaging or disengaging the ratchet mechanism.

The periphery of the ratchet shaft 32 is configured with fins 56. Mounted in close radial proximity to these fins 56 are two lock plates 58 which pivot around pins 60. So that the lock plates 58 have some flexibility in their movement, each is in contact with a deformable spring 62. The lock plates take on different positions relative to the pivot points depending on rotation of the adjustment collar 14. This coupling is mediated by protrusions 64 projecting from the inner surface of the adjustment collar 14 which in certain positions press against the springs 62 which abut the lock plates 58.

FIG. 5A illustrates that the protrusions 64 do not contact the springs 62 when the tool is operated in power drill/driving mode. As such, the lock plates 58 do not contact the fins 56 of the ratchet shaft 32. However, in a reverse manual ratchet mode illustrated in FIG. 5B, the protrusions 64 tend to contact portions of the springs 62 so that the lock plates 58 pivot about the pins 60. As such, one of the two arms 66 of each respective lock plate 58 contacts a slot 68 between the fins 56 of the ratchet shaft 32. However, since the springs 62 are flexible, the lock plates 58 are able to move out of these slots 68 to permit the ratchet shaft 32 to rotate in the direction indicated by arrow 70. Rotation allows the aims 66 to return into contact with the slots 68 under the force of the springs 62. This creates the well-known ratchet sound when the ratchet shaft 32 is engaged in this fashion.

Rotation of the ratchet shaft 32 in the opposite direction, however, drives the arms 66 of the lock plates 58 further into the slots 68, so that the ratchet shaft 32 is not able to rotate. Hence the ratchet shaft 32 and any other output shaft rotationally coupled is only capable of unidirectional rotation.

FIG. 5C illustrates a forward manual ratchet ode which functions analogously to the reverse manual ratchet mode. The only difference is the direction of rotation permitted by the ratchet means. Switching between the three possible operational modes is mediated by rotation of the adjustment collar 14, as is illustrated by comparing FIG. 4A with FIG. 4B. When the collar 14 is orientated so that the tool 10 is operating in forward or reverse ratchet mode, the adjustment ring 48 is in such a position that the spindle 28 is definitively de-coupled from the ratchet shaft 32.

In this case, the user may use the tool 10 much as it were simply an unpowered screwdriving device by rotating the handle 24. Since the handle 24 is coupled with the motor housing 18 and the motor housing 18 is coupled with the gearbox housing 16 and the gearbox housing 16 is rotationally coupled to the lock plates 58 via the pins 60 (see FIG. 3). Therefore, rotation of the handle 24 in one direction will be such that the lock plates 58 drive the ratchet shaft 32 and therefore the output shaft. Rotation in the other direction will simply cause the lock plates 58 to rotate around the ratchet shaft 32 creating a typical ratchet sound. In this way, conventional ratchet action is achieved.

In an alternate construction, the coupling means are positioned instead between the motor pinion 26 and the planetary gear transmission 20. The adjustment collar 14 can in this case be enlarged so that it can still couple with both the ratchet means and the shaft coupling means.

The foregoing relates to the preferred exemplary embodiment of the invention, it being understood that other variants and embodiments thereof are possible within the spirit and scope of the invention, the latter being defined by the appended claims.

We claim:

1. A rotary power tool having a manual ratchet mechanism comprising:

a driveshaft driven by a motor;

an output shaft;

a disengageable shaft coupling element mechanically coupling the driveshaft to the output shaft, wherein the shaft coupling element is generally ring-shaped and at least partially surrounds the driveshaft and the output shaft in a power drill-driving mode; and a disengageable ratchet element blocking rotation of the output shaft unidirectionally in an unpowered manual ratcheting mode and disengaged from the output shaft in the power drill-driving mode, wherein when one of the shaft coupling element and the ratchet element is engaged, the other one is disengaged, wherein the rotary tool further includes an adjustment element for adjusting an operational mode of the rotary tool from the power drill-driving mode to the unpowered manual ratcheting mode, wherein the ratchet element comprises a ratchet shaft configured with fins on an outer periphery of the shaft which interact with at least one locking plate, wherein in the unpowered manual ratcheting mode the at least one locking plate is configured to pivot about a pin into contact with the fins under the force of a spring which directly engages the at least one locking plate, and wherein at least one protrusion projects from an inner surface of the adjustment element and, in the unpowered manual ratcheting mode, presses against the spring to pivot the at least one locking plate into contact with the fins.

2. A rotary tool according to claim 1, wherein the shaft coupling element moves axially along a tool axis of rotation when moving from an engaged to a disengaged position.

3. A rotary tool according to claim 2, wherein a biasing member urges the shaft coupling element to move axially into either the engaged or the disengaged position.

4. A rotary tool according to claim 3, wherein a transmission modulates output of the motor to transform speed and torque of a spindle, and the shaft coupling element is positioned between the transmission and the ratchet element.

5. A rotary tool according to claim 2, wherein a transmission modulates output of the motor to transform speed and torque of a spindle, and the shaft coupling element is positioned between the transmission and the ratchet element.

6. A rotary tool according to claim 2, wherein the generally ring-shaped shaft coupling element is moved axially along a tool axis of rotation to a position surrounding only the driveshaft and/or output shaft in a ratcheting mode.

7. A rotary tool according to claim 1, wherein a transmission modulates output of the motor to transform speed and torque of a spindle, and the shaft coupling element is positioned between the transmission and the ratchet element.

8. A rotary tool according to claim 1, wherein the generally ring-shaped shaft coupling element is moved axially along a tool axis of rotation to a position surrounding only the driveshaft in a ratcheting mode.

9. A rotary tool according to claim 8, wherein an inner surface of the shaft coupling element is configured with splines for coupling with the driveshaft and/or the output shaft.

10. A rotary tool according to claim 1, wherein an inner surface of the shaft coupling element is configured with splines for coupling with the driveshaft and/or the output shaft.

11. A rotary tool according to claim 1, wherein the motor has a motor housing which is mechanically coupled with the ratchet element.

12. A rotary tool according to claim 11, wherein the adjustment element is mechanically coupled to the shaft coupling element and the ratchet element, and adjusts each into either an engaged or a disengaged position.

13. A rotary tool according to claim 12, wherein the operational mode of the adjustment element can be used to determine a direction of unidirectional blocking by the ratchet element.

14. A rotary tool according to claim 13, wherein the adjustment element comprises a rotatable collar and the at least one protrusion projects from the inner surface of the collar against the spring in the unpowered manual ratcheting mode.

15. A rotary tool according to claim 13, wherein the adjustment element comprises a rotatable collar with an inner cam surface for adjusting the shaft coupling element.

16. A rotary tool according to claim 12, wherein the adjustment element comprises a rotatable collar and the at least one protrusion projects from the inner surface of the collar against the spring in the unpowered manual ratcheting mode.

17. A rotary tool according to claim 16, wherein the adjustment element comprises a rotatable collar with an inner cam surface for adjusting the shaft coupling element.

18. A rotary tool according to claim 12, wherein the adjustment element comprises a rotatable collar with an inner cam surface for adjusting the shaft coupling element.

19. A rotary tool according to claim 1, wherein the at least one locking plate comprises two locking plates each configured to pivot about a pin into contact with the fins under the force of springs, one spring directly engaging one of the locking plates and another spring directly engaging the other locking plate, and the at least one protrusion comprises two protrusions projecting from the inner surface of the adjustment element and, in the unpowered manual ratcheting mode, one of the protrusions presses against the one spring to pivot the one locking plate into contact with the fins and the other protrusion presses against the another spring to pivot the other locking plate into contact with the fins.

20. A rotary power tool having a manual ratchet mechanism comprising:

a driveshaft driven by a motor;

an output shaft;

a disengagable shaft coupling element mechanically coupling the driveshaft to the output shaft and at least partially surrounding the driveshaft and the output shaft in a power drill-driving mode;

a disengageable ratchet element blocking rotation of the output shaft unidirectionally in an unpowered manual ratcheting mode; and an adjustment element for adjusting an operational mode of the rotary tool between the power drill-driving mode and the unpowered manual ratcheting mode, the adjustment element configured to (i) simultaneously engage the ratchet element with the output shaft and disengage the shaft coupling element to decouple the driveshaft from the output shaft during operation in the unpowered manual ratcheting mode, and (ii) simultaneously disengage the ratchet element from the output shaft and engage the shaft coupling element to couple the driveshaft to the output shaft during operation in the power drill-driving mode.

* * * * *